US011988491B1

(12) United States Patent
Eckstein, Jr. et al.

(10) Patent No.: US 11,988,491 B1
(45) Date of Patent: May 21, 2024

(54) PROJECTILE AND CASELESS CARTRIDGE

(71) Applicant: Revolutionary Rounds L.L.C., Gilbert, AZ (US)

(72) Inventors: Richard L. Eckstein, Jr., Gilbert, AZ (US); Linda H. Eckstein, Gilbert, AZ (US); Lucas R. Hayhurst, Glendale, AZ (US)

(73) Assignee: Revolutionary Rounds L.L.C., Gilbert, AZ (US)

( * ) Notice: Subject to any disclaimer, the term of this patent is extended or adjusted under 35 U.S.C. 154(b) by 0 days.

(21) Appl. No.: 17/389,215

(22) Filed: Jul. 29, 2021

(51) Int. Cl.
*F42B 5/18* (2006.01)
*F42B 5/184* (2006.01)
*F42B 10/04* (2006.01)

(52) U.S. Cl.
CPC ..... *F42B 5/182* (2013.01); *F42B 5/184* (2013.01); *F42B 10/04* (2013.01)

(58) Field of Classification Search
None
See application file for complete search history.

(56) References Cited

U.S. PATENT DOCUMENTS 670,728 A * 3/1901 Pool ..... F42B 10/40 102/490
696,295 A * 3/1902 Angell et al. ..... F42B 5/18 102/431
3,098,444 A * 7/1963 Walkey ..... F42B 5/18 102/431
3,148,472 A 9/1964 Hegge
3,216,356 A * 11/1965 Kaufmann, Jr. ..... F42B 5/05 102/431
3,336,871 A 8/1967 Quinlan
3,396,658 A 8/1968 Scanlon
3,645,206 A 2/1972 Quinlan
3,688,697 A * 9/1972 Paul ..... F42B 5/18 102/431
3,705,549 A * 12/1972 Quinlan ..... F42B 5/18 102/431

(Continued)

FOREIGN PATENT DOCUMENTS

DE 10237707 A1 3/2004
DE 102004048522 A1 4/2006

(Continued)

*Primary Examiner* — Derrick R Morgan
(74) *Attorney, Agent, or Firm* — BOOTH UDALL FULLER, PLC

(57) ABSTRACT

A caseless cartridge with a projectile, a propellant, and an ignition source. The ignition source is configured to ignite the propellant in response to an activation of the firearm. The propellant is molded around the projectile and is configured to propel the projectile from the firearm upon ignition. When the firearm is activated, the propellant is consumed, and the projectile and the ignition source are discharged from the firearm. The projectile has a bullet, an ignition housing, and a shaft. The bullet is positioned on a leading end of the projectile, while the ignition housing is positioned on a trailing end opposite the leading end. The shaft extends between the projectile and the ignition housing. The projectile may also have a plurality of fins to stabilize the projectile during flight and a plurality of ignition ports. The ignition source may ignite the propellant through the plurality of ignition ports.

8 Claims, 20 Drawing Sheets

(56) References Cited

U.S. PATENT DOCUMENTS 3,714,728 A 2/1973 Perkins
3,732,819 A * 5/1973 Quinlan ..... F42B 5/34 102/700
3,734,020 A * 5/1973 Ciccone ..... F42B 5/16 149/19.91
3,795,195 A 3/1974 Irish
3,823,668 A 7/1974 Remaly
3,848,530 A 11/1974 Pllumer
4,000,697 A 1/1977 Levine
4,015,527 A 4/1977 Evans
4,724,017 A * 2/1988 Eich ..... F42B 5/18 149/9
4,763,577 A * 8/1988 Romer ..... F42C 19/0826 102/431
4,770,099 A * 9/1988 Brede ..... F42C 19/12 102/431
4,887,534 A * 12/1989 Dickovich ..... F42C 19/0826 102/373
5,042,388 A * 8/1991 Warren ..... F42B 5/045 102/434
H1353 H * 9/1994 Malejko ..... 102/431
5,712,445 A * 1/1998 Kassuelke ..... F42B 5/181 102/288
5,726,378 A * 3/1998 Barrett ..... C06B 45/00 102/431
6,158,348 A * 12/2000 Campoli ..... F42C 19/0826 102/434
6,526,892 B2 * 3/2003 Heitmann ..... F42C 19/06 89/6
6,647,889 B1 11/2003 Biserod
6,725,781 B2 * 4/2004 Niemeyer ..... F42B 5/02 102/472
7,610,856 B2 * 11/2009 Stark ..... F42C 19/0826 102/431
7,690,305 B2 * 4/2010 Harjula ..... F42B 30/12 102/373
8,430,033 B2 * 4/2013 Mutascio ..... F42B 5/18 102/431
8,590,452 B2 * 11/2013 Tiainen ..... F41F 1/06 102/446
11,041,701 B1 * 6/2021 Moy ..... F42B 5/16
2002/0170455 A1 * 11/2002 Pierrot ..... F42B 5/181 102/472
2005/0082419 A1 * 4/2005 Dryer ..... F42B 30/12 244/3.3
2006/0096485 A1 * 5/2006 Stark ..... F42C 19/0826 102/431
2007/0144393 A1 6/2007 Kusz
2007/0289474 A1 * 12/2007 Mutascio ..... F42B 5/02 102/431
2010/0229750 A1 * 9/2010 Mutascio ..... F42B 5/18 102/431

FOREIGN PATENT DOCUMENTS

EP 1431701 A1 6/2004
GB 1372068 10/1974
WO 1993/018364 9/1993

* cited by examiner

PROJECTILE AND CASELESS CARTRIDGE

TECHNICAL FIELD

This document relates to a projectile and caseless cartridge.

BACKGROUND

A typical cartridge for a firearm usually includes a projectile, propellant, and an ignition source. These components are typically contained within a casing. Thus, when discharged, the ignition source ignites the propellant, which discharges the projectile from the firearm. The ignition source and the casing are left behind within the firearm and must be removed either manually or automatically. This extra step requires extra time and introduces additional potential malfunctions of the firearm. In addition, producing a casing for every round significantly increases the cost.

SUMMARY

Aspects of this document relate to a caseless cartridge comprising a projectile having a bullet positioned on a leading end of the projectile and sized to exit a firearm through a barrel of the firearm, the bullet having an aerodynamic shape, an ignition housing positioned on a trailing end of the projectile opposite the leading end, the ignition housing having a cross section equal to or smaller than a cross section of the bullet, a shaft extending between the bullet and the ignition housing and joining the bullet to the ignition housing, wherein the shaft is hollow and an interior of the shaft is fluidly coupled to an interior of the ignition housing, a plurality of fins extending away from the shaft along a portion of the shaft, wherein the fins are configured to stabilize the projectile during flight, and a plurality of ignition ports extending through a wall of the shaft and through the ignition housing, a propellant molded around the projectile and configured to propel the projectile from the firearm upon ignition, and an ignition source positioned within the ignition housing and configured to ignite the propellant in response to an activation of the firearm, wherein the ignition source ignites the propellant through the plurality of ignition ports, wherein when the firearm is activated, the propellant is consumed and the projectile and the ignition source are discharged from the firearm.

Particular embodiments may comprise one or more of the following features. The bullet, the ignition housing, and the shaft may be formed of a single piece. When the firearm is activated, each component of the caseless cartridge may be either consumed or discharged from the firearm through the barrel.

Aspects of this document relate to a caseless cartridge comprising a projectile having a bullet positioned on a leading end of the projectile and sized to exit a firearm through a barrel of the firearm, an ignition housing positioned on a trailing end of the projectile opposite the leading end and configured to contain an ignition source, the ignition housing having a cross section equal to or smaller than a cross section of the bullet, a shaft extending between the bullet and the ignition housing and joining the bullet to the ignition housing, wherein the shaft is hollow and an interior of the shaft is fluidly coupled to an interior of the ignition housing, a plurality of fins extending away from the shaft, wherein the fins are configured to stabilize the projectile during flight, and a plurality of ignition ports extending through a wall of the shaft and through the ignition housing, wherein when the firearm is activated, the projectile is discharged from the firearm.

Particular embodiments may comprise one or more of the following features. The caseless cartridge may further comprise a propellant molded around the projectile and configured to propel the projectile from the firearm upon ignition. The caseless cartridge may further comprise the ignition source positioned within the ignition housing, wherein the ignition source is configured to ignite a propellant in response to an activation of the firearm. The ignition source may ignite the propellant through the plurality of ignition ports. The bullet, the ignition housing, and the shaft may be formed of a single piece. When the firearm is activated, each component of the caseless cartridge may be either consumed or discharged from the firearm through the barrel.

Aspects of this document relate to a caseless cartridge comprising a projectile having a bullet positioned on a leading end of the projectile and sized to exit a firearm through a barrel of the firearm, an ignition housing positioned on a trailing end of the projectile opposite the leading end and configured to contain an ignition source, and a shaft extending between the bullet and the ignition housing and joining the bullet to the ignition housing, wherein when the firearm is activated, the projectile is discharged from the firearm.

Particular embodiments may comprise one or more of the following features. The caseless cartridge may further comprise a plurality of ignition ports extending through the ignition housing, wherein the ignition source is configured to ignite the propellant through the plurality of ignition ports. The caseless cartridge may further comprise a plurality of ignition ports extending through a wall of the shaft, wherein the shaft is hollow and an interior of the shaft is fluidly coupled to an interior of the ignition housing, and wherein the ignition source is configured to ignite the propellant through the plurality of ignition ports. The caseless cartridge may further comprise a plurality of fins extending away from the shaft, wherein the fins are configured to stabilize the projectile during flight. The caseless cartridge may further comprise a propellant molded around the projectile and configured to propel the projectile from the firearm upon ignition. The bullet, the ignition housing, and the shaft may be formed of a single piece. When the firearm is activated, each component of the caseless cartridge may be either consumed or discharged from the firearm through the barrel. The ignition source may be a mechanical ignition source. The ignition source may be a primer. The ignition source may be an electronic ignition style ignitor.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
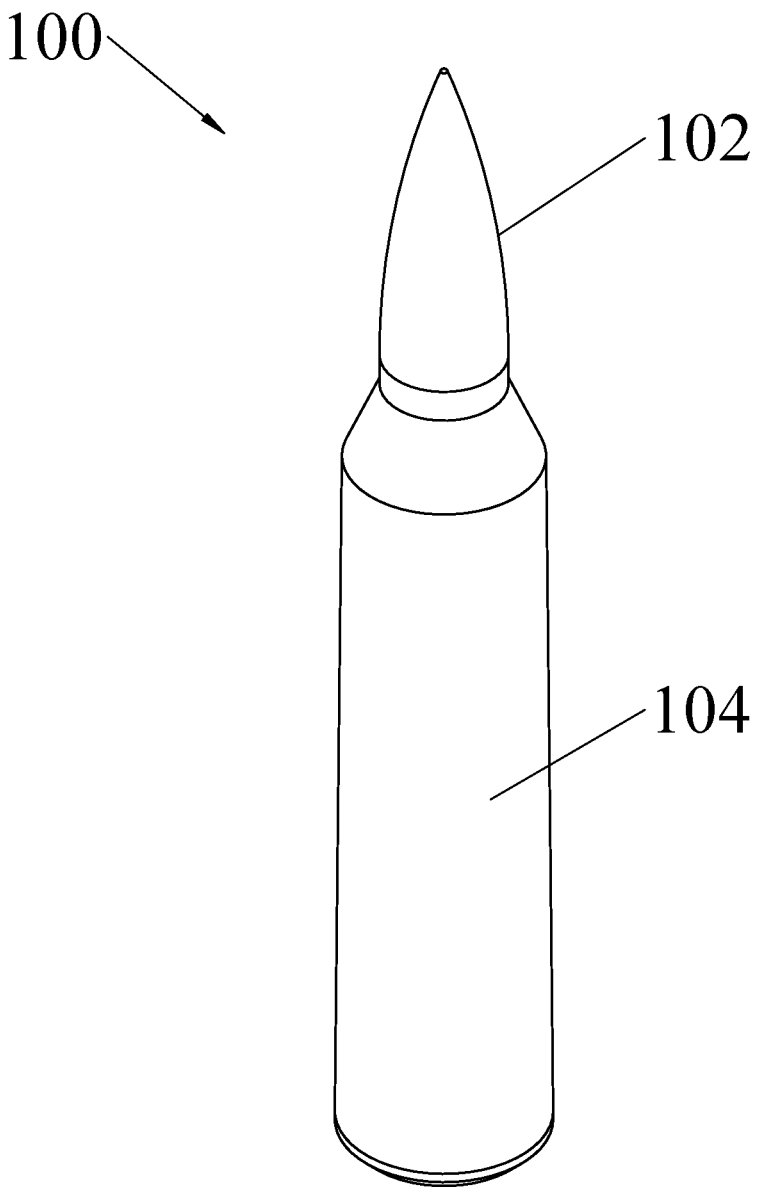
FIG. 1 is a perspective view of a first embodiment of a caseless cartridge.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations.

It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Figure 2:
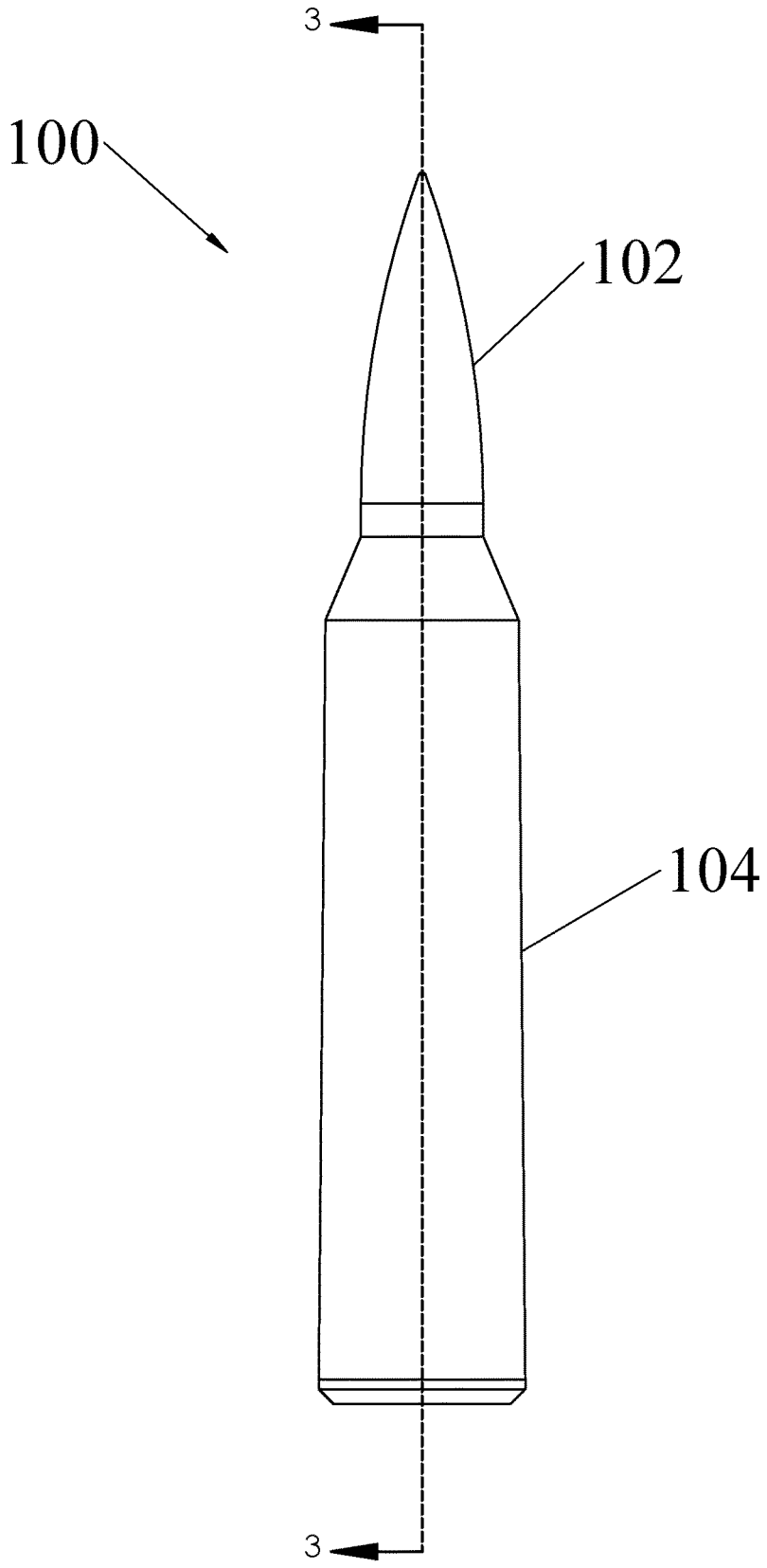
FIG. 2 is a side view of the caseless cartridge shown in FIG. 1.
Figure 3:
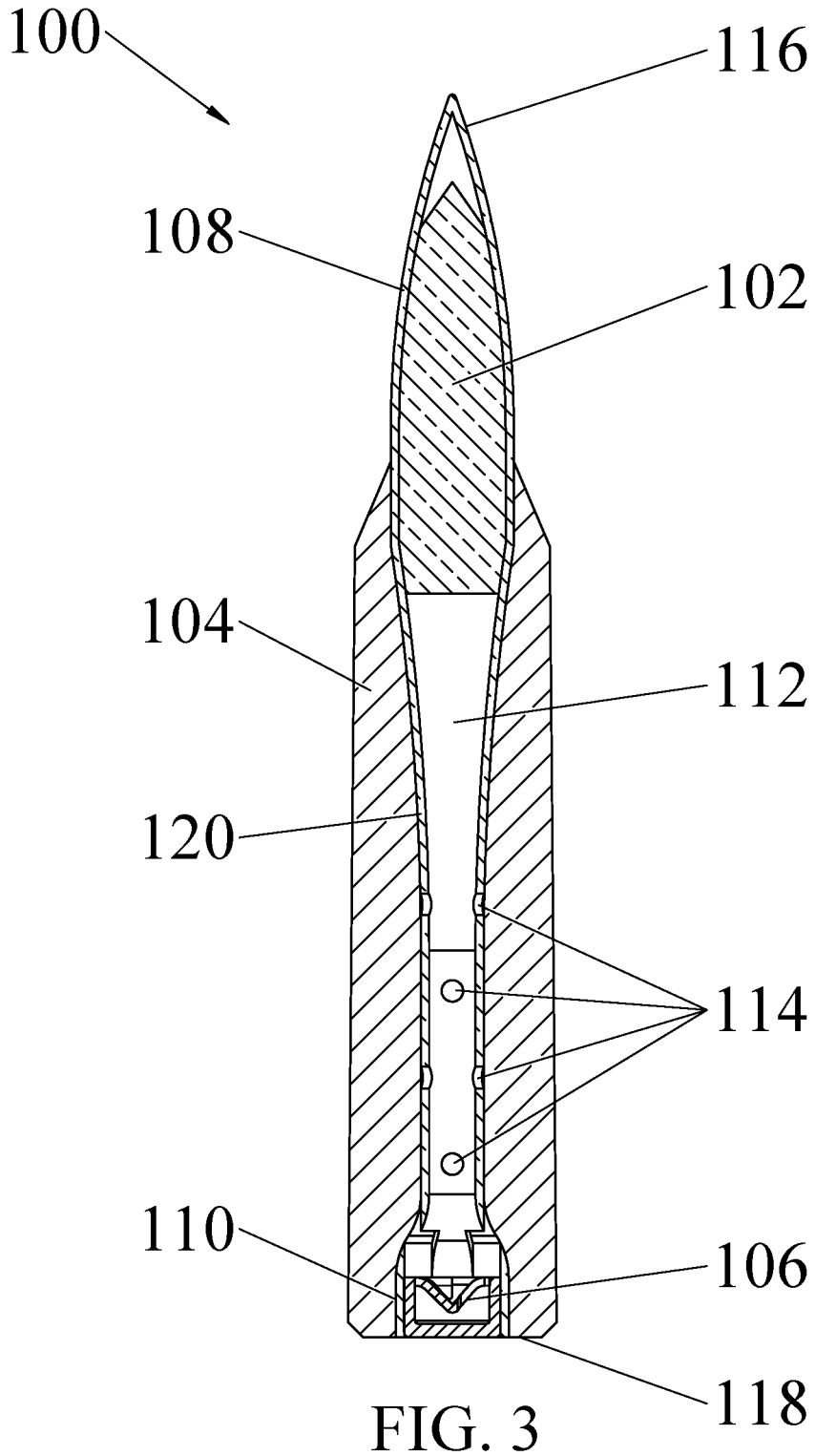
FIG. 3 is a cross section view of the caseless cartridge shown in FIG. 2 taken along line 3-3.
Figure 4:
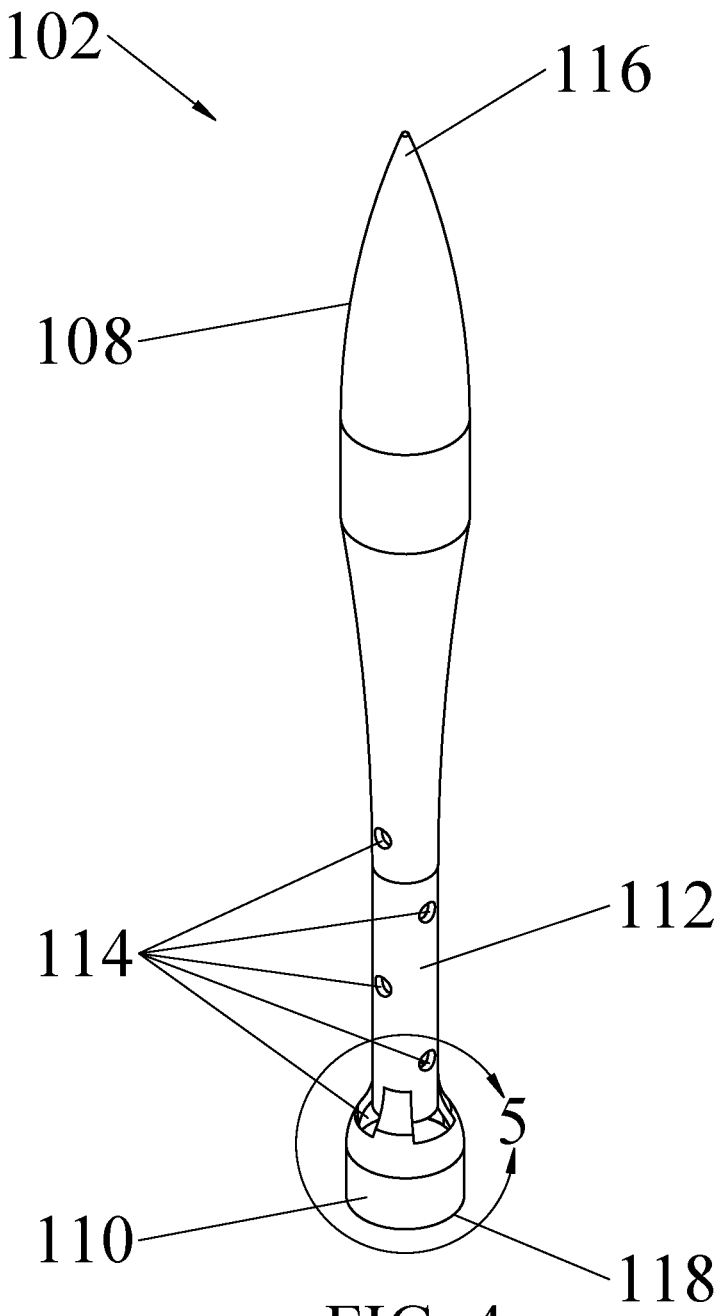
FIG. 4 is a perspective view of the projectile of the caseless cartridge shown in FIG. 1.
Figure 5:
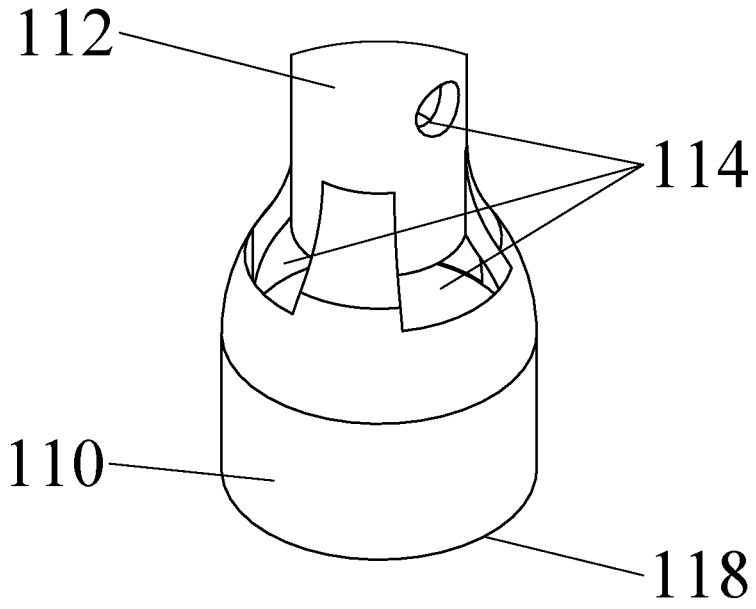
FIG. 5 is a close-up view of the ignition housing of the projectile shown in FIG. 4, taken from circle 5.
Figure 6:
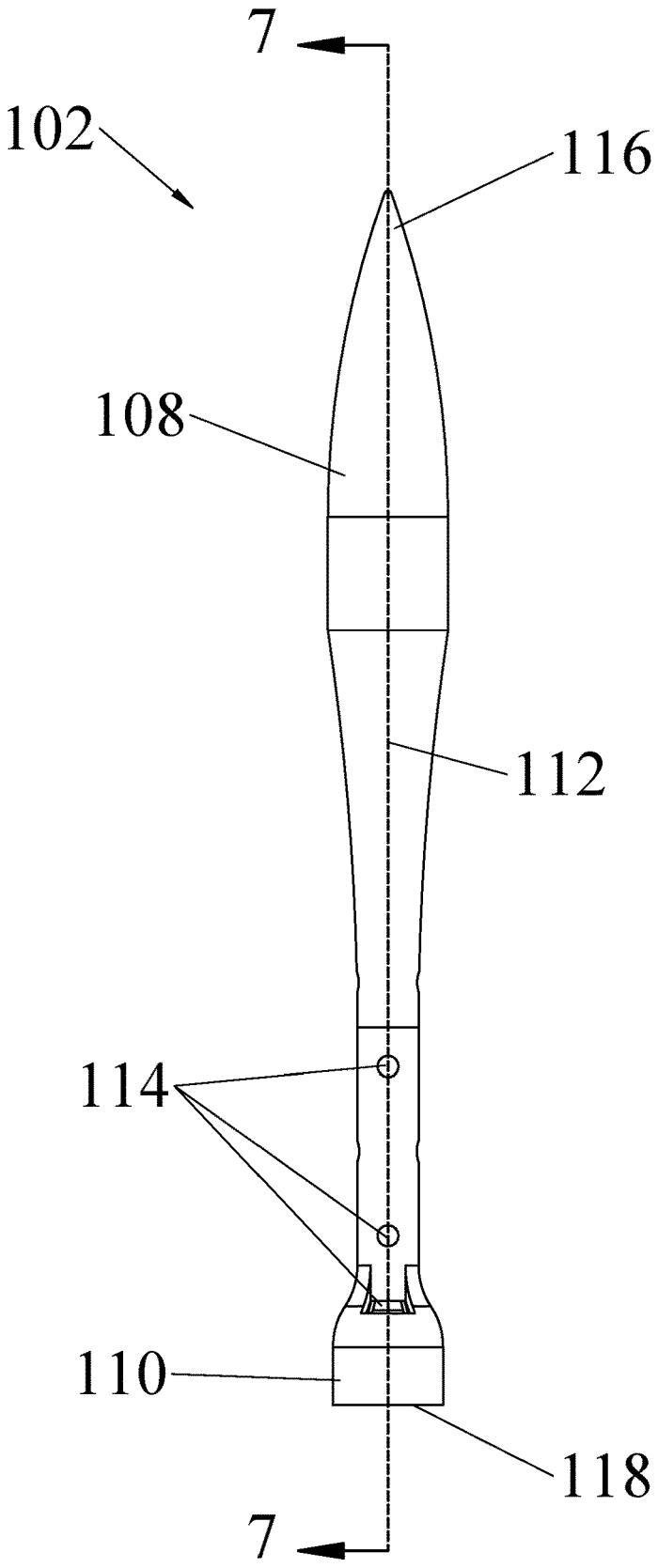
FIG. 6 is a side view of the projectile shown in FIG. 4.
Figure 7:
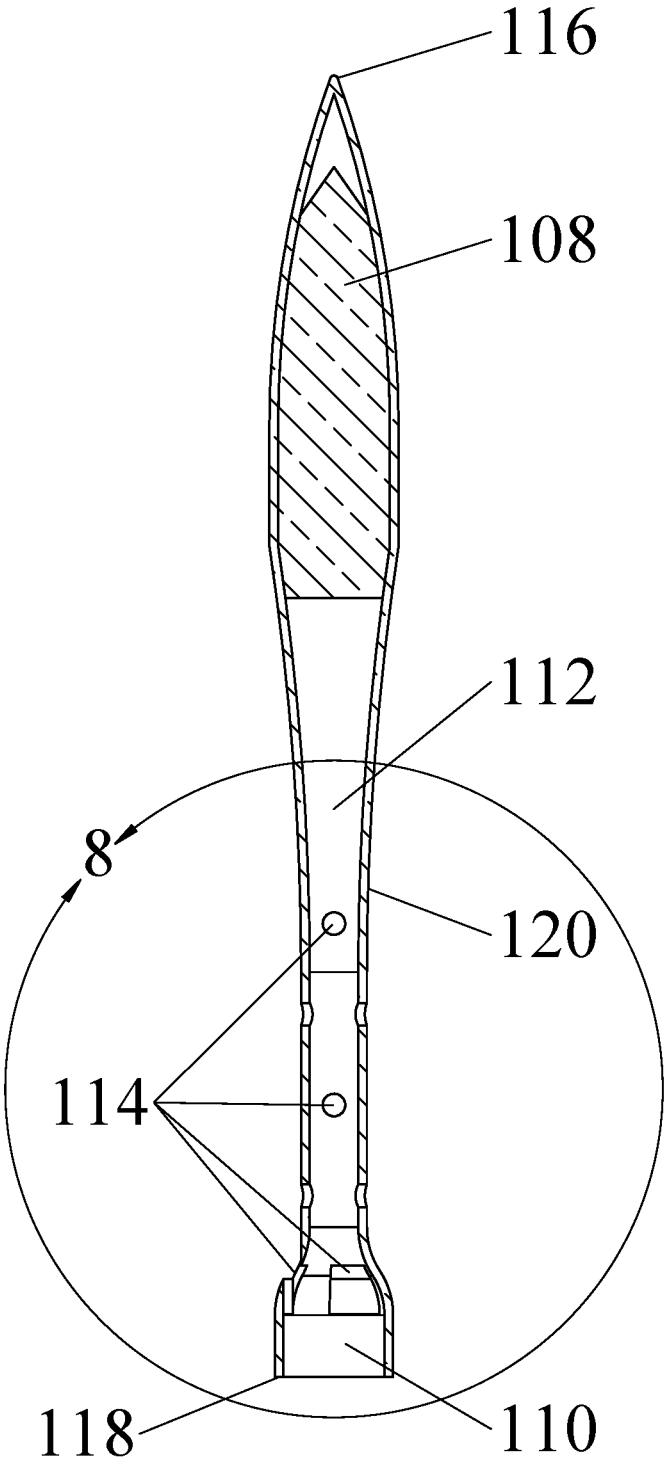
FIG. 7 is a cross section view of the projectile shown in FIG. 4 taken along line 7-7.
Figure 8:
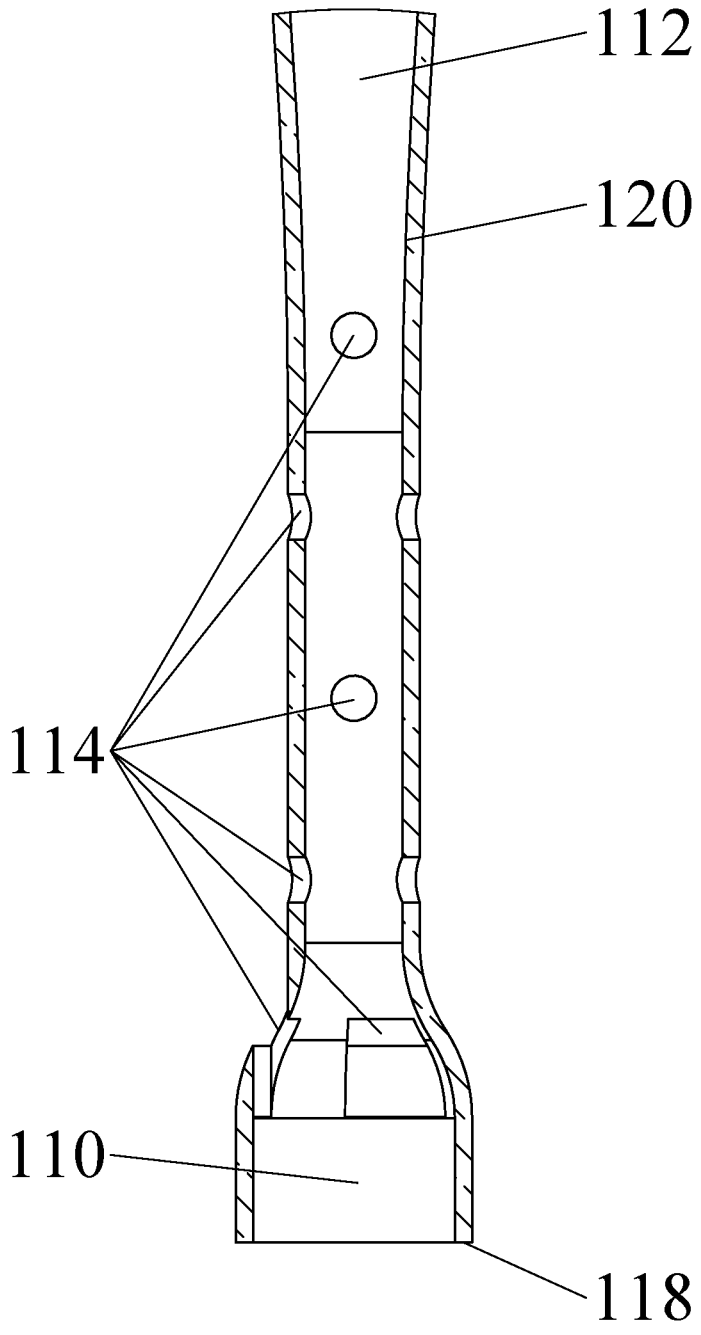
FIG. 8 is a close-up view of the cross section of the shaft and ignition housing of the projectile shown in FIG. 7, taken from circle 8.
Figure 9:
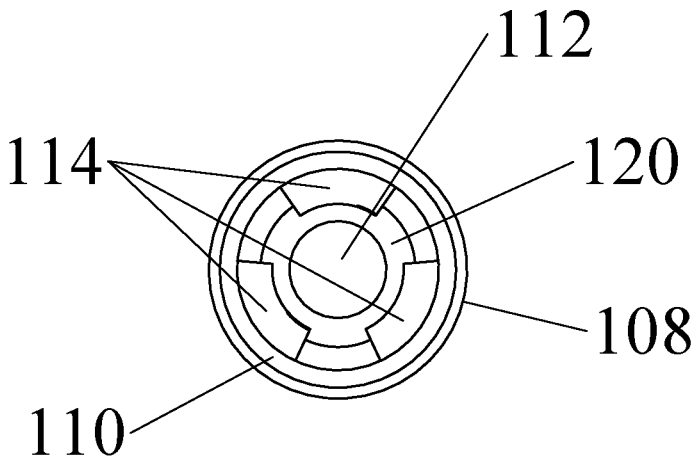
FIG. 9 is a bottom view of the projectile shown in FIG. 4.

The present disclosure relates to a caseless cartridge 100. As shown in FIGS. 1-3, the caseless cartridge 100 may comprise a projectile 102, a propellant 104, and an ignition source 106. The caseless cartridge 100 and its components are dimensionally scalable and the caseless cartridge 100 is configured to fit within the form and envelope of any preexisting or future caliber chamber profile. The caseless cartridge 100 thus eliminates the need for a current form metallic casing and an ejection cycle of a weapon and requires no modification to existing weapon platforms.

The propellant 104 may be case-hardened and may be molded around and bonded to the projectile 102. This eliminates the need for a casing and simplifies production of the caseless cartridge 100. The propellant 104 is configured to propel the projectile 102 from the firearm upon ignition of the propellant 104 by building up pressure behind the projectile 102 as the propellant 104 is consumed. The ignition source 106 is coupled to or integrated with the projectile 102 and is configured to ignite the propellant 104 in response to an activation of the firearm. Because the ignition source 106 is coupled to the projectile 102, the ignition source 106 is also propelled from the firearm upon ignition of the propellant 104. Thus, once the firearm is activated, the propellant 104 is consumed and the projectile 102 and the ignition source 106 are discharged from the firearm. In some embodiments, each component of the caseless cartridge 100 is either consumed or discharged from the firearm when the firearm is activated.

The ignition source 106 may be a mechanical ignition source, such as a primer. In such an embodiment, the ignition source 106 is configured to produce heat when struck. This heat is transferred to the propellant 104, which ignites and propels the projectile 102 from the firearm. Alternatively, the ignition source 106 may be an electronic ignition style ignitor. In such an embodiment, an electric current may be used to generate heat to ignite the propellant 104. A primer may still be included, and the electric current may be used to cause the primer to produce heat. Alternatively, there may not be a primer, and instead, the electric current may generate heat in another way, such as through generation of a plasma that ignites the propellant 104.

Turning to FIGS. 4-9, the projectile 102 may comprise a bullet 108, an ignition housing 110, a shaft 112, and a plurality of ignition ports 114. The bullet 108 may be positioned on a leading end 116 of the projectile 102 and is sized to exit the firearm through the barrel of the firearm. The bullet 108 may have an aerodynamic shape configured to reduce drag on the projectile 102 during flight. The ignition housing 110 may be positioned on a trailing end 118 of the projectile 102. The trailing end 118 is opposite the leading end 116. In some embodiments, the propellant 104 is molded around the ignition housing 110, the shaft 112, and the back end of the bullet 108.

Figure 10:
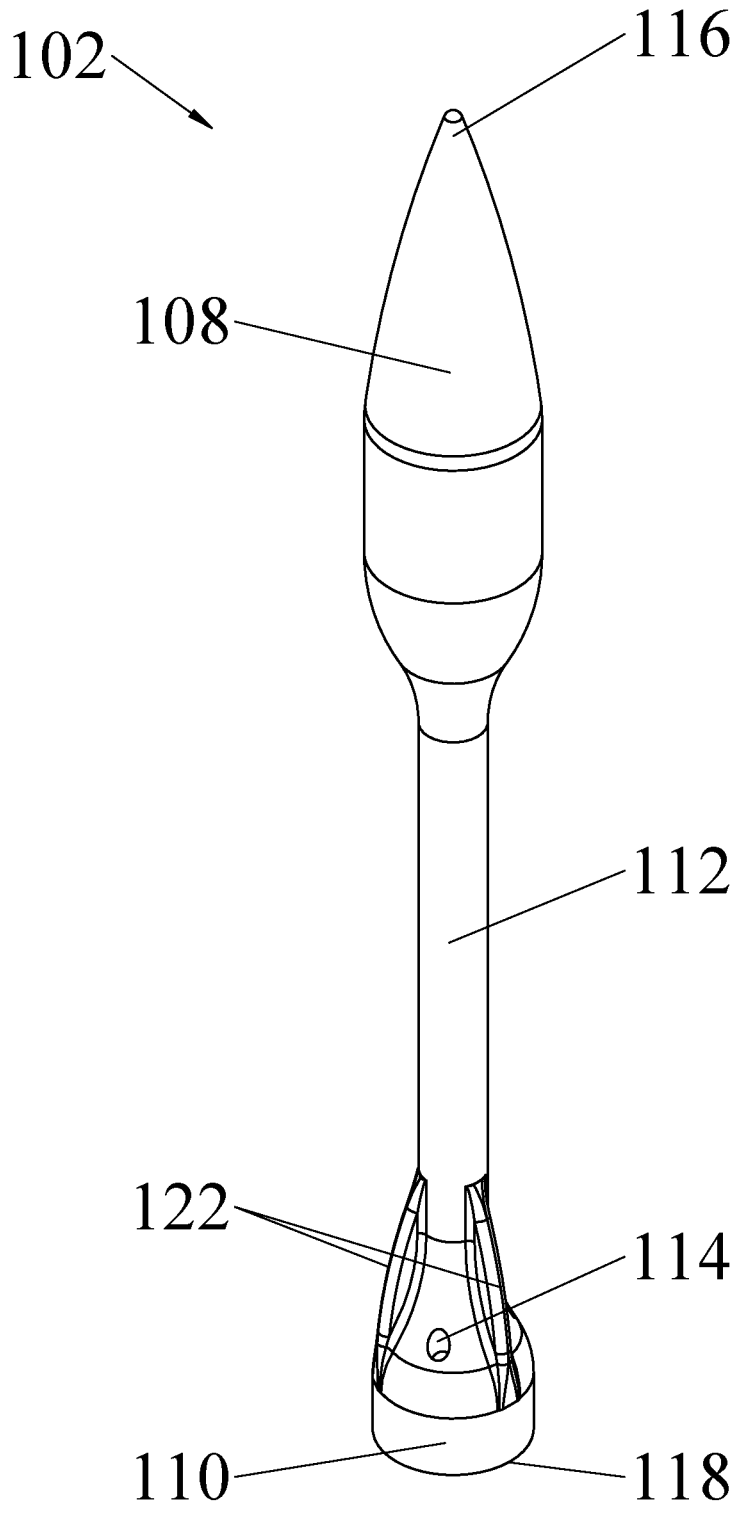
FIG. 10 is a perspective view of a second embodiment of the projectile.
Figure 11:
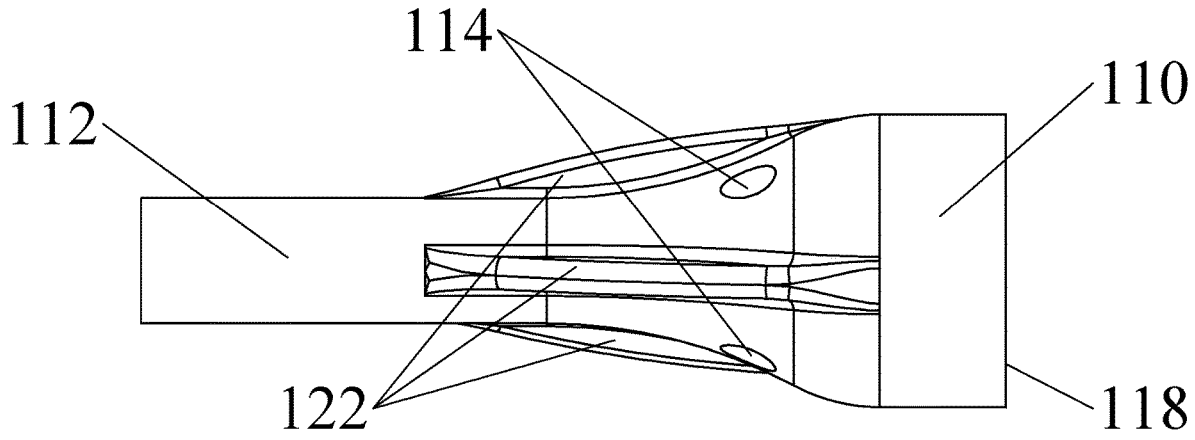
FIG. 11 is a close-up view of the shaft and ignition housing of the projectile shown in FIG. 10.
Figure 12:
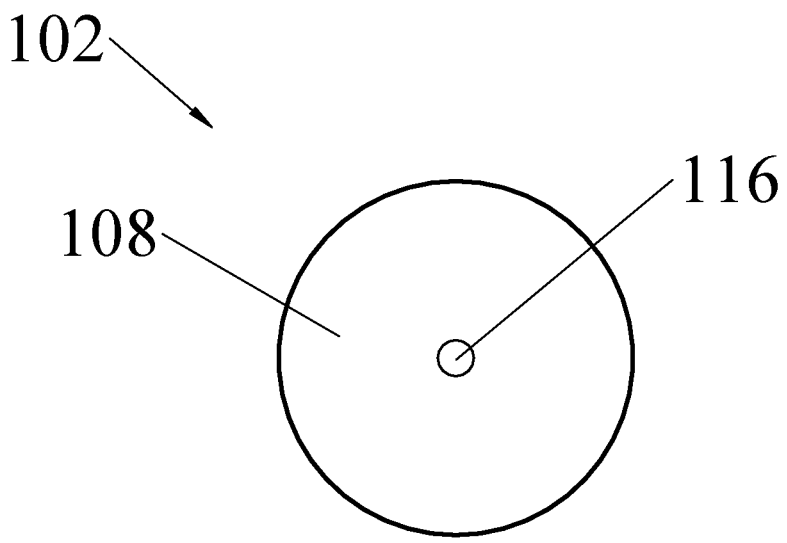
FIG. 12 is a top view of the projectile shown in FIG. 10.
Figure 13:
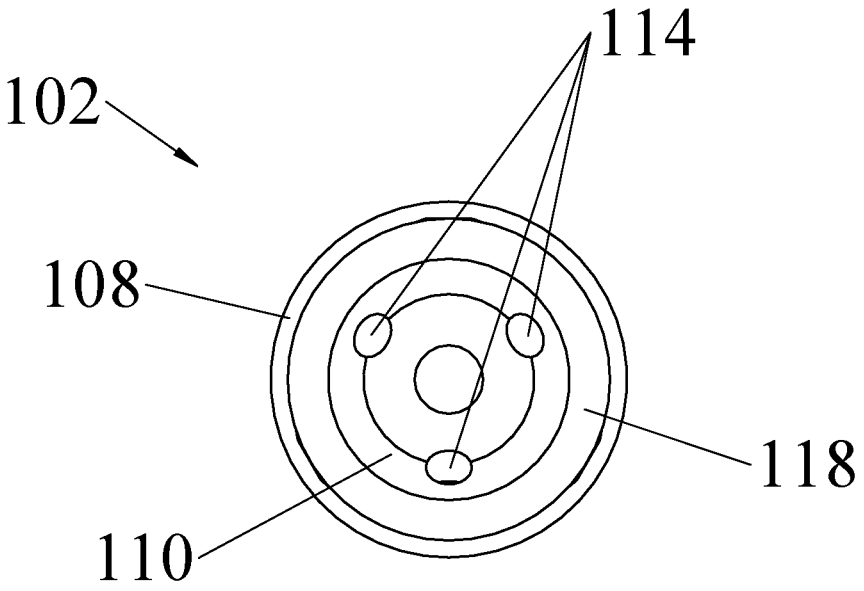
FIG. 13 is a bottom view of the projectile shown in FIG. 10.
Figure 14:
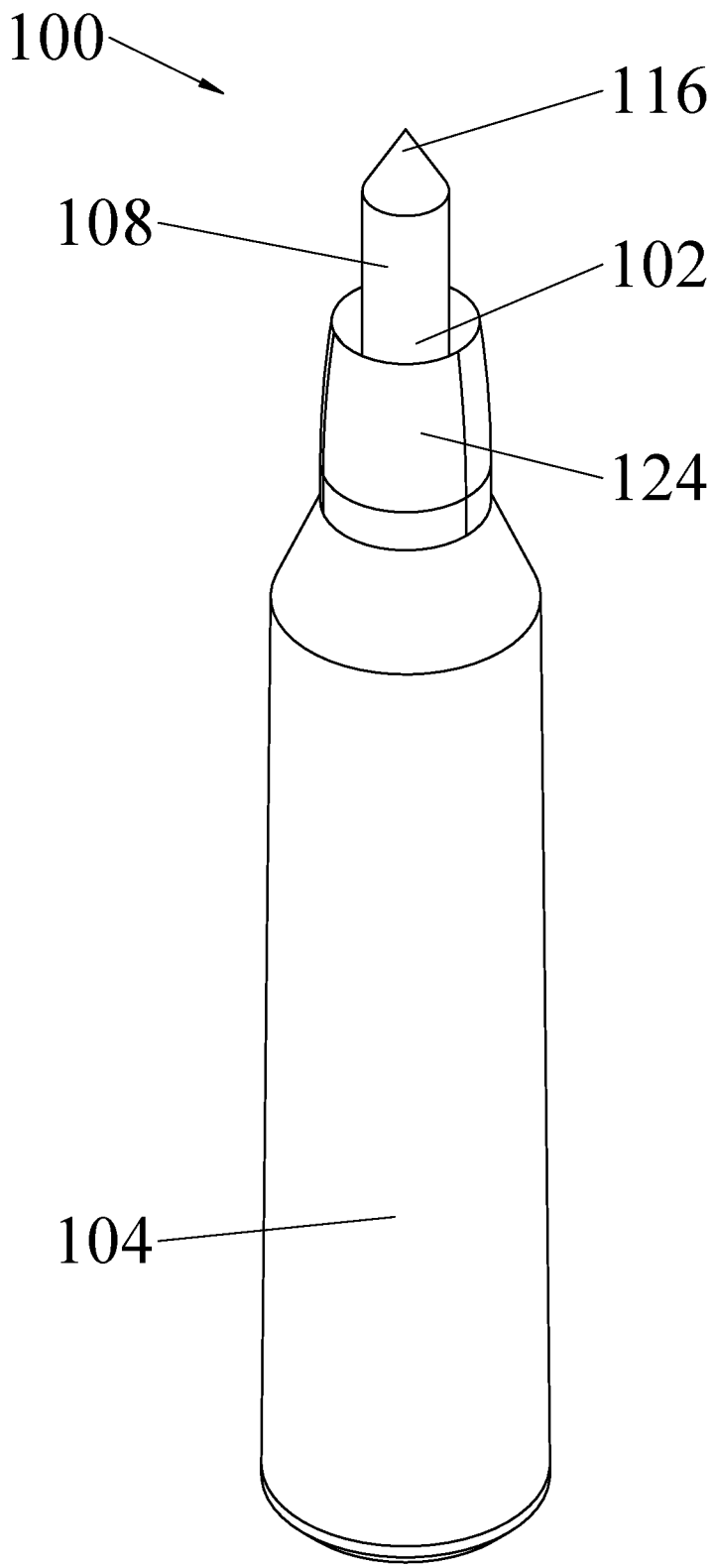
FIG. 14 is a perspective view of a third embodiment of a caseless cartridge with a sabot.
Figure 15:
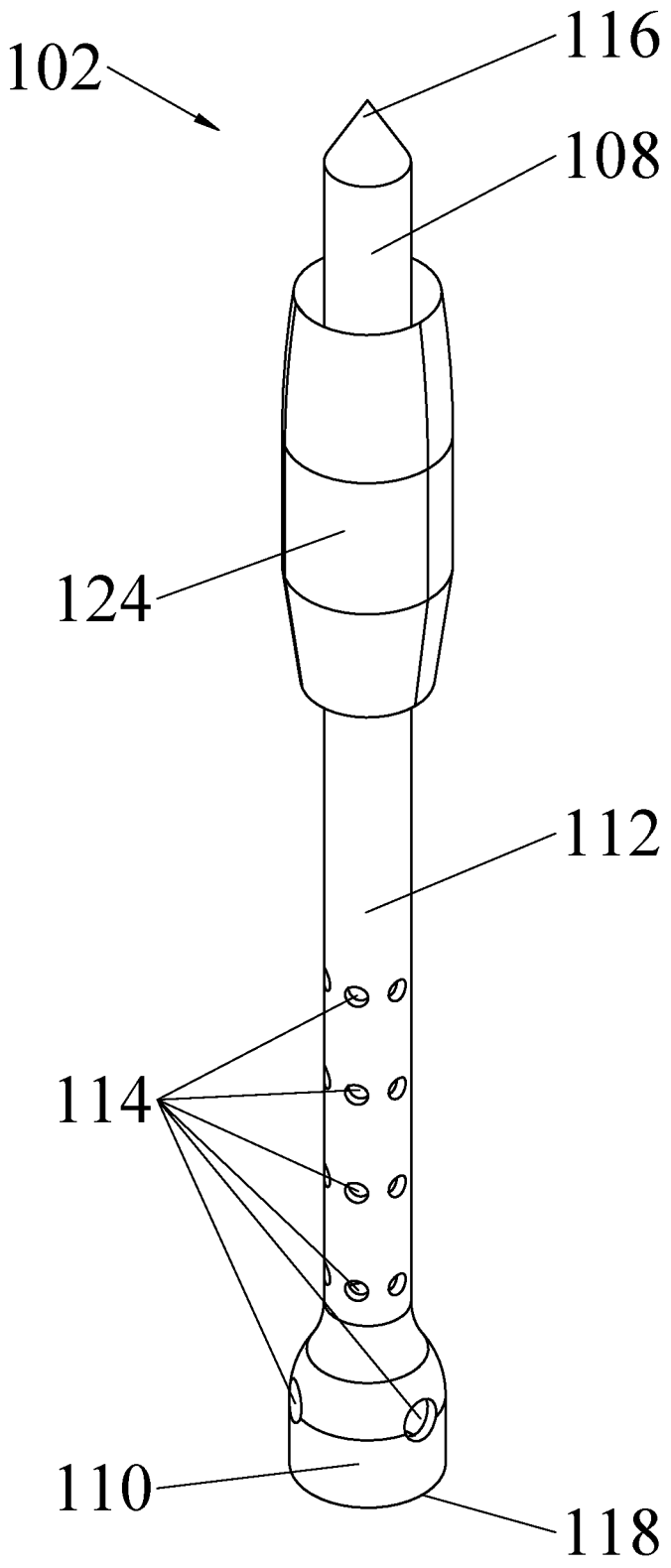
FIG. 15 is a perspective view of the caseless cartridge shown in FIG. 14 with the propellant removed.

In some embodiments, such as in the embodiment shown in FIGS. 1-9 and the embodiment shown in FIGS. 10-13, the ignition housing 110 may have a cross section equal to or smaller than a cross section of the bullet 108 (see FIGS. 12-13). However, in other embodiments, such as the embodiment shown in FIGS. 14-20, the bullet 108 may have a cross section smaller than the cross section of the ignition housing 110. The ignition housing 110 is configured to contain the ignition source 106, with the ignition source 106 embedded into the ignition housing 110.

The shaft 112 extends between the bullet 108 and the ignition housing 110 and joins the bullet 108 to the ignition housing 110. As mentioned above, this causes the ignition housing 110, and thus the ignition source 106, to be propelled from the firearm with the bullet 108. In some embodiments, the shaft 112, the bullet 108, and the ignition housing 110 are formed of a single piece. In some embodiments, the shaft 112 is hollow, and the interior of the shaft 112 may be fluidly coupled to the interior of the ignition housing 110. Additionally, a plurality of ignition ports 114 may extend through a wall 120 of the shaft 112, through the ignition housing 110, or both through the wall 120 and through the ignition housing 110. For example, FIGS. 4-9 and FIGS. 14-20 both illustrate embodiments of a projectile 102 with ignition ports 114 extending through the wall 120 of the shaft 112 and through the ignition housing 110. As another example, FIGS. 10-13 illustrate an embodiment with ignition ports 114 extending only through the ignition housing 110. In the embodiment shown in FIGS. 10-13, the shaft 112 is solid instead of hollow. The ignition source 106 may be configured to ignite the propellant 104 through the plurality of ignition ports 114. Thus, the ignition ports 114 are configured to facilitate the ignition of the propellant 104 by increasing the amount of propellant 104 that is directly exposed to the ignition source 106. In embodiments that have more ignition ports 114, the heat produced by the ignition source 106 directly contacts and potentially ignites more of the propellant 104, thus leading to a faster and more effective ignition of the propellant 104. Close-up views of various embodiments of the ignition ports 114 are provided in FIGS. 5, 8, 9, 11, 13, and 18.

Turning to the embodiment shown in FIGS. 10-13, the projectile may also have a plurality of fins 122. The plurality of fins 122 extend radially away from the shaft 112. The plurality of fins 122 may extend along a portion of the shaft 112, as shown in FIGS. 10-11. Alternatively, the plurality of fins 122 may extend along the length of the shaft 112 or may extend from a different component of the caseless cartridge 100 and therefore may not extend from the shaft 112 at all. The plurality of fins 122 are configured to stabilize the projectile 102 during flight. This may help improve the accuracy of the projectile 102.

Figure 16:
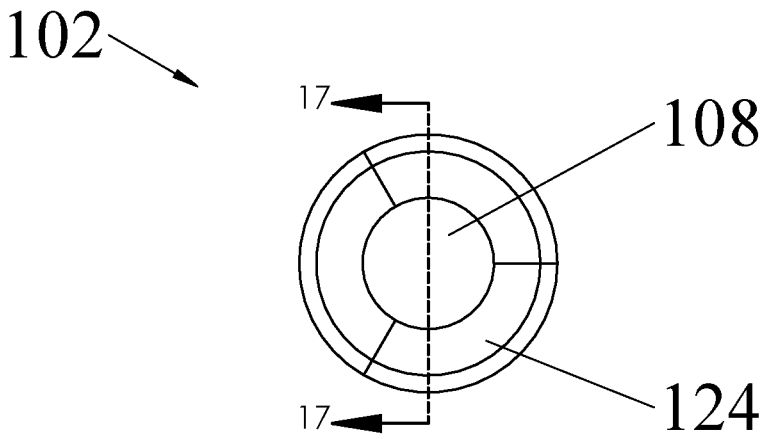
FIG. 16 is a top view of the caseless cartridge shown in FIG. 15.
Figure 17:
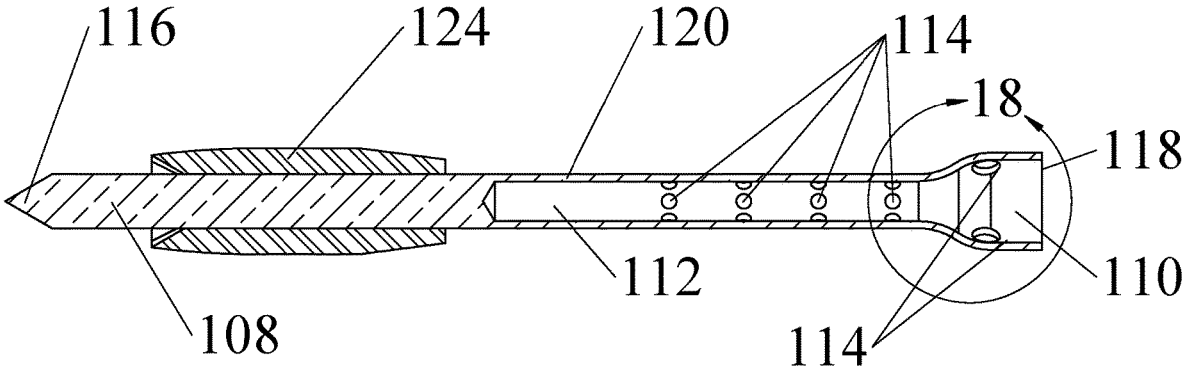
FIG. 17 is a cross section view of the caseless cartridge shown in FIG. 16, taken along line 17-17.
Figure 18:
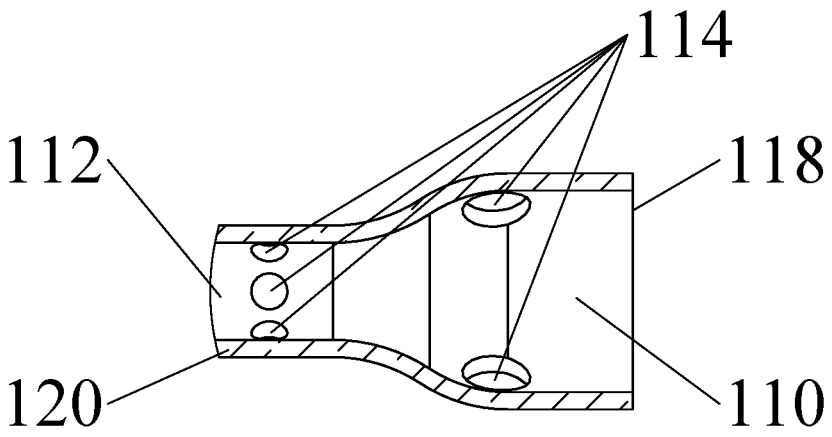
FIG. 18 is a close-up view of the cross section of the shaft and ignition housing of the caseless cartridge shown in FIG. 17, taken from circle 18.
Figure 19:
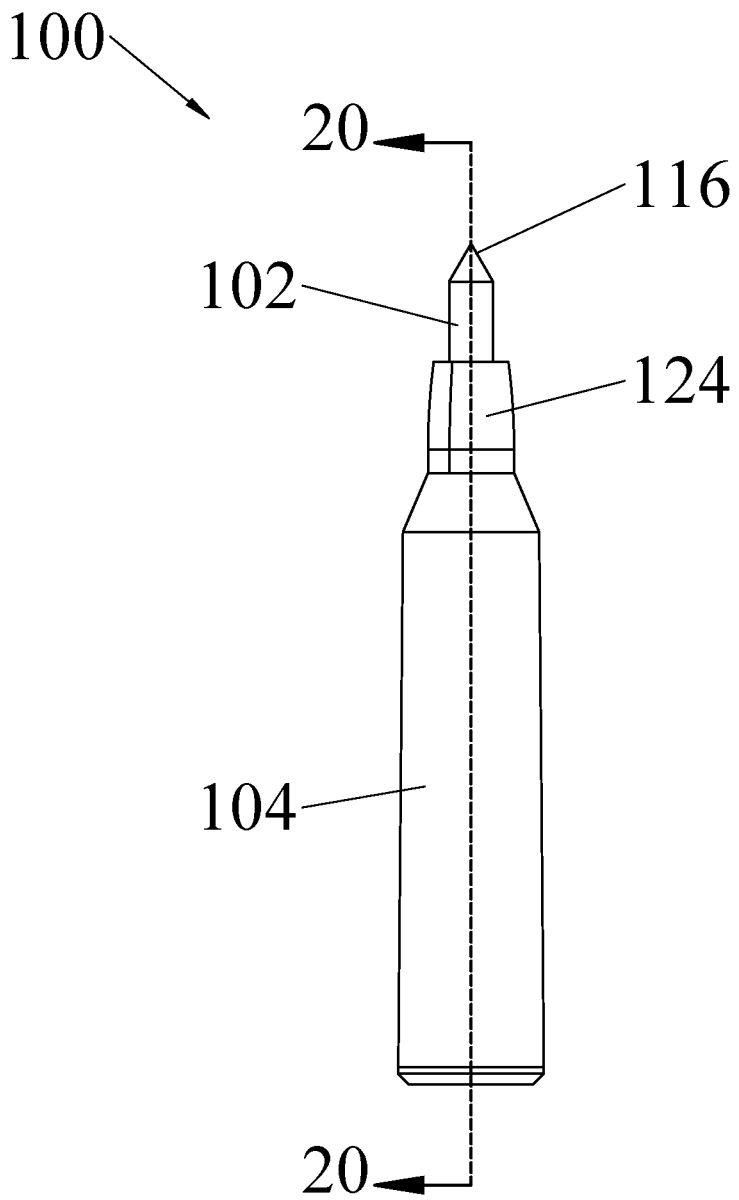
FIG. 19 is a side view of the caseless cartridge shown in FIG. 14.
Figure 20:
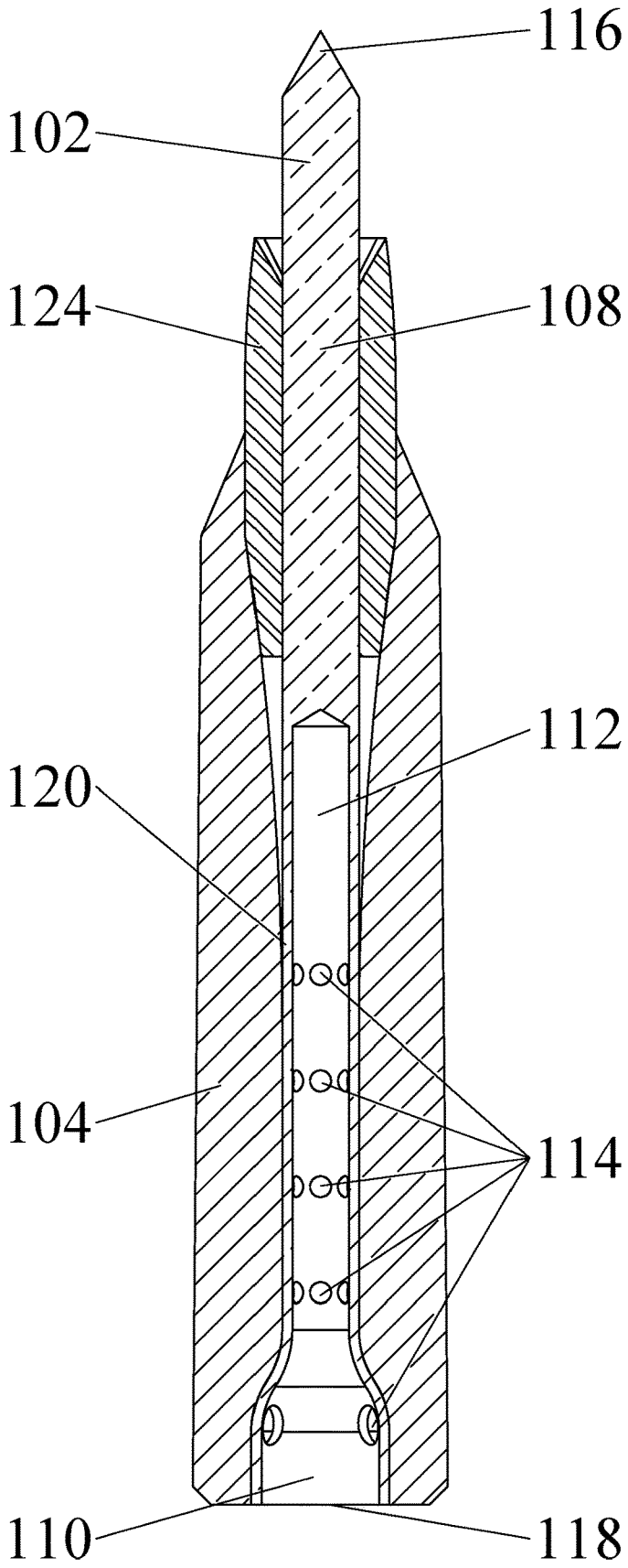
FIG. 20 is a cross section view of the caseless cartridge shown in FIG. 19, taken along line 20-20.

The projectile 102 may be adapted to any existing type of bullet or exiting caliber or future caliber or type of ammunition. For example, FIGS. 14-20 illustrate another embodiment of the caseless cartridge 100 in which the projectile 102 is a different size and shape. The caseless cartridge 100 may have a bullet 108 that has a smaller diameter than the ignition housing 110, as shown. For such an embodiment to fit through the barrel of the firearm, the barrel must be large enough for the ignition housing 110, leaving the bullet 108 without necessary stabilizing support along the length of the barrel. Thus, the caseless cartridge 100 may further comprise a sabot 124. The sabot 124 is configured to center the bullet 108 in the barrel and improve the accuracy of the projectile 102. Additionally, once the caseless cartridge 100 exits the barrel of the firearm, the sabot 124 is configured to separate from the projectile 102. For example, the sabot 124 wrapped around the projectile 102 in FIG. 16 is divided into three pieces. Thus, as the projectile 102 moves through the barrel, the sabot 124 stays wrapped around the projectile 102, but once the projectile 102 leaves the barrel, the sabot 124 easily separates without significantly detracting from the momentum of the projectile 102.

It will be understood that implementations of a caseless cartridge are not limited to the specific assemblies, devices and components disclosed in this document, as virtually any assemblies, devices and components consistent with the intended operation of a caseless cartridge may be used. Accordingly, for example, although particular caseless cartridges, and other assemblies, devices and components are disclosed, such may include any shape, size, style, type, model, version, class, measurement, concentration, material, weight, quantity, and/or the like consistent with the intended operation of caseless cartridges. Implementations are not limited to uses of any specific assemblies, devices and components; provided that the assemblies, devices and components selected are consistent with the intended operation of a caseless cartridge.

Accordingly, the components defining any caseless cartridge may be formed of any of many different types of materials or combinations thereof that can readily be formed into shaped objects provided that the materials selected are consistent with the intended operation of a caseless cartridge. For example, the projectile components may be formed of: metals, such as zinc, magnesium, titanium, copper, lead, iron, steel, carbon steel, alloy steel, tool steel, stainless steel, brass, nickel, tin, antimony, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various caseless cartridges may be manufactured using conventional procedures as added to and improved upon through the procedures described here. Some components defining a caseless cartridge may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, molding, casting, forging, cold rolling, milling, drilling, reaming, turning, grinding, stamping, cutting, bending, welding, soldering, hardening, punching, plating, and/or the like. If any of the components are manufactured separately, they may then be coupled with one another in any manner, such as with a weld, a fastener, any combination thereof, and/or the like for example, depending on, among other considerations, the particular material forming the components.

It will be understood that methods for manufacturing or assembling caseless cartridges are not limited to the specific order of steps as disclosed in this document. Any steps or sequence of steps of the assembly of a caseless cartridge indicated herein are given as examples of possible steps or sequence of steps and not as limitations, since various assembly processes and sequences of steps may be used to assemble caseless cartridges.

The implementations of a caseless cartridge described are by way of example or explanation and not by way of limitation. Rather, any description relating to the foregoing is for the exemplary purposes of this disclosure, and implementations may also be used with similar results for a variety of other applications employing a caseless cartridge.

What is claimed is:

1. A caseless cartridge comprising:

a projectile having:

a bullet positioned on a leading end of the projectile and sized to exit a firearm through a barrel of the firearm;

an ignition housing positioned on a trailing end of the projectile opposite the leading end and configured to contain an ignition source, the ignition source positioned within the ignition housing, wherein the ignition source is configured to ignite a propellant in response to an activation of the firearm; and a shaft extending between the bullet and the ignition housing and joining the bullet to the ignition housing, wherein the ignition housing is fixedly attached to the shaft through a plurality of arms extending from the ignition housing to the shaft; a plurality of ignition ports extending through a wall of the shaft, wherein the shaft is hollow and an interior of the shaft is fluidly coupled to an interior of the ignition housing, and wherein the ignition source is configured to ignite the propellant through the plurality of ignition ports wherein when the firearm is activated, each component of the caseless cartridge is either consumed or discharged from the firearm through the barrel.

2. The caseless cartridge of claim 1, the projectile further comprising a plurality of ignition ports extending through the ignition housing, wherein the ignition source is configured to ignite the propellant through the plurality of ignition ports.

3. The caseless cartridge of claim 1, the projectile further comprising a plurality of fins extending away from the shaft, wherein the fins are configured to stabilize the projectile during flight.

4. The caseless cartridge of claim 1, further comprising a propellant molded around the projectile and configured to propel the projectile from the firearm upon ignition.

5. The caseless cartridge of claim 1, wherein the bullet, the ignition housing, and the shaft are formed of a single piece.

6. The caseless cartridge of claim 1, wherein the ignition source is a mechanical ignition source.

7. The caseless cartridge of claim 6, wherein the ignition source is a primer.

8. The caseless cartridge of claim 1, wherein the ignition source is an electronic ignition style ignitor.

* * * * *